United States Patent [19]

Werner et al.

[11] 3,964,249

[45] June 22, 1976

[54] YARN WITH RANDOM DENIER FLUCTUATIONS

[75] Inventors: Helmut Werner, Elsenfeld; Hans Stapp, Momlingen, both of Germany

[73] Assignee: Akzona Incorporated, Asheville, N.C.

[22] Filed: Nov. 6, 1969

[21] Appl. No.: 369,151

Related U.S. Application Data

[62] Division of Ser. No. 630,819, April 14, 1967, Pat. No. 3,478,143.

[30] Foreign Application Priority Data

Apr. 27, 1966 Germany ..... V 30940
Apr. 27, 1966 Germany ..... V 18921

[52] U.S. Cl. ..... 57/140 J; 428/397; 428/399

[51] Int. Cl.[2] ..... D02G 3/34; D01D 5/20

[58] Field of Search ..... 57/140 J, 157 S; 264/167, 290 T, 290 R, 290 N; 428/362, 364, 369, 397, 399, 400

[56] References Cited

UNITED STATES PATENTS

| | | | |
|---|---|---|---|
| 2,975,474 | 3/1961 | Smith | 57/140 J |
| 3,117,173 | 1/1964 | Adams | 57/140 J |
| 3,127,915 | 4/1964 | Bottomley | 57/140 J |
| 3,275,732 | 9/1966 | Macleod et al. | 264/167 X |
| 3,363,295 | 1/1968 | Allen | 264/290 T |
| 3,422,176 | 1/1969 | Jamison | 264/167 |
| 3,439,489 | 4/1969 | Holton et al. | 57/140 J |

*Primary Examiner*—John Petrakes
*Attorney, Agent, or Firm*—Johnston, Keil, Thompson & Shurtleff

[57] ABSTRACT

A method of producing novel polyester yarns, threads or fabrics in which a previously unstretched melt-spun yarn such as polyethylene terephthalate is stretched upon a stationary heated stretching pin of a diameter of 15–60mm. and a pin temperature of 60°–105°C., the yarn being drawn at a stretching ratio of 60–80 percent of the normal ratio while placing the yarn under a thread tension after the pin of 0.2 to 1.1 grams/denier with a ratio of thread tension after the pin to that before the pin of 1:1.5 to 1.4. The resulting novel yarn is characterized by an elongation at breaking point of 30–80 percent, a boiling shrinkage capacity (at 100°C. in water) of 20–50 percent and a large number of random denier fluctuations or variations per unit length of about 15–35 nodules per meter spaced at random intervals of about 0.5 to 8 centimeters. These yarns are particularly useful when fabricated into a textile structure and dyed, e.g. with basic dyes or dispersion dyes, so as to provide a different strength of dyeing as between the thicker and thinner portions of the yarn.

6 Claims, No Drawings

YARN WITH RANDOM DENIER FLUCTUATIONS

The present application is a division of application Ser. No. 630,819, which was filed on Apr. 14, 1967, now U.S. Pat. No. 3,478,143.

In general, this invention relates to a method for the manufacture of a yarn having denier fluctuations or variations of random size and placement along the length of the yarn, and the invention also provides a novel yarn having such random denier fluctuations and textile products made therefrom.

A number of methods have been suggested for producing yarn or threads with a fluctuating denier, i.e. with lengthwise portions of the yarn or threads having different diameters. For example, this has been accomplished by a controlled irregularity in the feed rate of the fiber-forming mass to the spinning nozzles. The pressure variations resulting from these controlled changes of the feed rate cause corresponding changes in the thickness of the resulting thread. In another known method, the filaments or threads are drawn off from the spinning nozzles at a variable or changing velocity, e.g. the drawing spool is operated in such a manner that it stands still at irregular intervals, thereby forming nodules, nubs or burls.

It is extremely difficult, however, to produce truly random placement of such nodules in the yarn. Unless the spinning apparatus or other devices provide some means for programming the fluctuations by a completely random control free of any periodocity, prior methods always lead to so-called patterns or designs in the textile products made from the same yarn. The production of a yarn with random fluctuations of denier can therefore be accomplished at the present time only with a great deal of effort and expense as well as being accompanied by serious technical difficulties in carrying out a conventional spinning and drawing process.

One can attempt to overcome these problems by simply reheating the spun yarn during the stretching operation, e.g. at intermittent portions along its length, but this technique merely results in relatively long and/or widely spaced thickened segments and also yields a yarn in which relatively highly stretched portions alternate with almost unstretched portions. These yarns are unsatisfactory not only because they have a correspondingly high breaking elongation but also because they fail to yield a highly random patterned effect of a large number of denier variations per unit length.

It is a primary object of the present invention to provide a method of producing novel yarns and textile goods in which individual polyester yarn or thread has been treated to impart random denier fluctuations characterized by an ideal statistically random distribution of the nodules with reference to their intervals along the length of the yarn and their variations in diameter.

Another object of the invention is to provide novel polyester yarns having an extremely higher number of relatively short and thick nodules per unit length of the yarn.

Still another object of the invention is to provide a method of producing random denier fluctuations in a polyester yarn in an economical manner and with easily controlled or regulated conditions and apparatus.

Other objects and advantages will become more apparent upon consideration of the following detailed specification.

It has now been found, in accordance with the invention, that the production of a yarn having many denier fluctuations of random size and sequence, i.e. in a completely irregular frequency, can be achieved in a very desirable manner by stretching or drawing a previously unstretched melt-spun polyester yarn upon and preferably about once around a stationary heated stretching pin. In order to achieve the desired result, it is essential to observe a number of critical conditions which cooperate with each other within certain limits. The absence of one or more of these conditions causes the desired denier fluctuations to immediately disappear or else causes such instability in the formation of nodules that one can no longer reproduce the desired effect so as to continuously produce threads of the same or nearly the same characteristics.

More particularly, these essential conditions include the following:

1. it is necessary to employ a fixed stretching pin of a larger diameter than that which has been previously used, the essential diameter being from 15 to 60 mm.;
2. The stretching pin must be maintained at a temperature of 60°C. to 105°C., preferably 65°C. to 85°C.;
3. The stretching ratio must be about 60 to 80 percent, preferably 66 to 74 percent, of the "normal stretching ratio" which is defined herein as the ratio of the unstretched length of yarn to its stretched length with reference to an initial yarn of the same denier which has been uniformly stretched to a breaking elongation of 20 percent;
4. The thread tension after the stretching pin, i.e. in the length of yarn following this pin, must correspond to a value of about 0.2 to 1.1 grams/denier, preferably about 0.45 to 0.9 grams/denier; and
5. The ratio of thread tension after the stretching pin to the thread tension before the pin should fall within limits of about 1:1.5 to 1:4, preferably about 1:1.9 to 1:2.6.

In addition, it has been found that the spinning velocity or so-called "spin-draw" can be worked out in relationship to the most favorable stretching ratio in approximately the same manner as in the normal production of a uniform denier yarn. This is illustrated in the following tabulation of values representing optimum results. The values of the stretch ratio in the last column can of course vary according to the desired effect and are independent of the other stretching conditions.

| Spinning velocity, meters/minute | Stretch Ratio | |
|---|---|---|
| | For yarn of 20% elongation | For yarn according to the invention |
| 800 | 1:4.34 | 1:3.1 |
| 1000 | 1:3.93 | 1:2.8 |
| 1200 | 1:3.64 | 1:2.5 |

When using the most common spinning velocities for polyester threads or yarns, it has been found that the best stretching ratio for purposes of the present invention is between about 1:2.2 and 1:3.4. However, a higher or lower spinning ratio can be used, depending upon the extent to which one deviates from conventional melt-spinning conditions.

The pin diameter, pin surface, pin temperature, stretching velocity, thread tension and stretch ratio all influence the desired effect in forming the nodules or thickened portions of the yarn to different degrees and quite considerably in some instances. The pin should of course have a reasonably smooth surface to avoid snagging, and one preferably employs a pin having a high gloss or dull chrome finish with a diameter of about 15 to 60 mm., preferably 25 to 40 mm. Above or below this range of the diameter, the effect on the thread vanishes. If the pin diameter is increased beyond this range, the resulting yarn has undesirable completely unstretched portions and proportionately long partly stretched portions. With a decreasing pin diameter, the desired effect is gradually reduced and finally vanishes completely.

It was further found that at the same values of tensile strength and elongation, the shrinkage of the yarn in boiling water (100°C.) unexpectedly increases with an increasing pin diameter. It was also surprising that the stretch velocity has no measurable effect on the characteristics of the resulting thread, but it was found that beginning with the lowest possible pin temperature of 60°C., the effect of providing the desired random denier fluctuations according to the invention is reduced with an increasing temperature. The level of tension on the yarn or thread following the stretching pin and especially the relationship of the thread tension before and after the stretching pin also have a decisive influence on the formation of the random nodules in the yarn.

The best stretch ratio for purposes of the invention is particularly dependent upon the spinning velocity or spin-draw with its related pre-orientation of the filaments during the melt-spinning process. For this reason, it is preferable to define the essential conditions of the process in terms of a percentage of the normal stretch ratio providing a 20 percent breaking elongation, since this parameter can also be further qualified so as to require the yarn to be drawn for purposes of the invention to provide an elongation value of 30 to 80 percent, preferably 35 to 65 percent, in the finished product. The above-noted values of stretching ratio, i.e. 1:2.2 to 1:3.4 and preferably 1:2.5 to 1:3.1, represent the limits for an initial unstretched polyester yarn which has been melt-spun at a drawing-off velocity of about 1200 to 800 meters/minute. Variations in the spinning or drawing-off velocity from these usual melt-spinning conditions naturally require a corresponding adjustment of the stretch ratio.

The finished yarn product of the stretching method of this invention has a number of novel and advantageous properties. In particular, the yarn exhibits a very high number of about 15 to 35, preferably 20 to 30, nodules or partly stretched thickened portions per meter length of the yarn, and these nodules are randomly spaced from one another at intervals ranging from about 0.5 to 8 centimeters, preferably about 0.8 to 6 centimeters. The yarn also exhibits a breaking elongation of about 30 to 80 percent, preferably 35 to 65 percent, and a shrinkage capacity in boiling water, i.e. at 100°C., of about 20 to 50 percent.

The yarns or threads of the invention are especially adapted to be processed into woven or knitted textile fabrics, either alone or in combination with other types of threads, and these fabrics can then be dyed with any known dyestuff for polyester fibers which is capable of yielding a different strength of dyeing as between the thicker and thinner portions of the special yarn of the invention. For example, there are a wide variety of basic dyes and dispersion dyes available for this purpose, i.e. which are recognized dyes which will enhance rather than cover the variable dyeability of yarns with denier fluctuations. A fabric composed of the yarn of the present invention has a texture as well as a completely random pattern quite similar to so-called Honan silk.

The variations in diameter of the yarn according to the invention are also completely irregular, and the ratio of maximum to minimum denier generally falls in a range of about 1.2:1 to 2.8:1. A cross-section at any particular point exhibits a degree of stretching someplace between a completely unstretched thread and a completely stretched thread, the enlarged or thickened portions of the yarn naturally exhibiting less stretching then the thinner portions. However, when stretching under the essential combination of conditions of the present invention, completely unstretched portions of the thread or yarn are quite minimal. One of the most important advantages of the yarn produced according to the invention resides in this completely irregular or random size of the nodule diameter as well as random nodule length and spacing, because textile fabrics or knitted goods produced from this yarn have an ideal texture without any danger of exhibiting so-called pictures, patterns or designs on the surface of the finished textile product.

Polyethylene terephthalate is the most common thermoplastic polymer employed for melt-spinning fiber-forming filaments and is therefore preferred for purposes of the present invention. However, other fiber-forming polyesters are equally suitable whether modified forms of polyethylene terephthalate or other well-known polyalkylene terephthalates of about 2 to 10 carbon atoms in the alkylene chain. These polyesters are produced according to well-known processes, e.g. as described in "Artificial Fibres" by Moncrieff, John Wiley & Sons, Inc., New York (1954), pp. 264–277, and as first developed according to the Whinfield and Dickson patent, U.S. Pat. No. 2,465,319. The process for melt-spinning such polymers is likewise conventional as well as the type of equipment or apparatus required. In general, it is preferred to use filaments which are melt-spun with diameters of approximately 25 my to 46 my. When stretched to a uniform denier with an elongation value of 20 percent, these filaments have an individual denier of 1.5 to 5.0.

Thus, in the overall process of spinning, stretching and fabricating the novel yarns of this invention, the heated stretching pin is the only device which requires a change from the conventional diameter to a larger diameter. In other respects, the polyester melt is spun from the usual spinneret or spinning nozzles and preferably drawn at a conventional spinning velocity while solidifying into unstretched filaments. These filaments as a thread or yarn are then collected on the usual take-up spool or they can be directed immediately to the stretching method of the invention. The apparatus for this stretching method is quite simple and inexpensive because the yarn is merely directed from a feed roll to a draw roll with the heated stretching pin interposed therebetween, the yarn preferably being wound approximately once around this pin. Conventional means can be used to heat this pin and to provide the required stretching velocity, stretch ratio and thread tension by using regulatable means of rotating the feed and draw rolls. The tension on the thread is best regulated by a slight variation of surface contact of the yarn with the circumference of the stretching pin.

Likewise, the processing or fabrication of the novel yarn into textile products can be carried out with any conventional apparatus using known weaving or knitting techniques. For example, the novel yarn can be used either as the warp or weft thread in combination with other natural or synthetic threads. However, the effect of denier fluctuations is especially enhanced by using the novel yarn in both warp and weft threads. Dyeing of the textile fabric is quite conventional, but again the desired effect is enhanced by avoiding the use of dyes which cover or mask the denier variations.

The invention is further illustrated by the following examples:

EXAMPLE 1

Polyethylene terephthalate was melt-spun at a spinning velocity of 1000 meters/minute into a yarn of a nominal titer 68 denier (measured as yarn stretched to a uniform denier having an elongation at break of 20 percent). The unstretched yarn was then processed at an average stretch velocity of 450 meters/minute on a stretching pin of 32 mm. diameter and having a dull chrome surface heated to a temperature of 65°C., the yarn being wrapped once around the pin and drawn at a stretch ratio of 1:2.8. The resulting yarn exhibited very pronounced denier variations. There were approximately 20 to 25 thick nubs or nodules per meter and distance between adjacent nodules fluctuated in a range of 1 to 5 centimeters. The variations in cross-sectional diameter of the individual nodules were in an area of about 1:2.8 as the ratio of thinner diameter to the nodule diameter, and substantially no completely unstretched portions existed in the yarn.

EXAMPLE 2

A series of tests were carried out to obtain polyethylene terephthalate yarns with denier fluctuations similar to that produced in Example 1 but using various stretch ratios in order to observe their effect on other characteristics of the finished yarn. These tests are summarized in the following table.

TABLE

| TEST NO. | UNSTRETCHED YARN | | STRETCHED YARN | | | |
|---|---|---|---|---|---|---|
| | Spinning velocity (meters/minute) | Nominal titer (denier)* | Stretch ratio | Actual ave. denier | Elongation at break(%) | Boiling shrinkage (%) |
| 1 | 1000 m/min | 45/18 | 1:2.80 | 63 | 61 | 43 |
| 2 | 1000 m/min | 45/18 | 1:3.04 | 58 | 50 | 30 |
| 3 | 1000 m/min | 45/18 | 1:3.20 | 55.5 | 45 | 25 |
| 4 | 1000 m/min | 45/18 | 1:3.37 | 53 | 36.5 | 20 |
| 5 | 1000 m/min | 68/24 | 1:2.80 | 98 | 67 | 45 |
| 6 | 1000 m/min | 68/24 | 1:3.04 | 91 | 60 | 33.5 |
| 7 | 1000 m/min | 68/24 | 1:3.20 | 86 | 50 | 26.0 |
| 8 | 1000 m/min | 68/24 | 1:3.37 | 76 | 42 | 20.5 |

*When stretched under normal conditions to a uniform denier with an elongation at break of 20%.

Each of the stretched yarns in the foregoing table were processed into fabrics as the weft threads, using normal polyester threads in the warp. When dyed with a red dispersion dye (RESOLINROT FB), the structure of which can be identified under Color Index No. Authrachinon C'J' dispers red 60, a striated, nubbed effect was produced which was more pronounced in the fabrics made from the heavier denier yarn than those made from the lighter denier yarn. Lower stretching ratios also tend to enhance the desired effect. Thus, at a high stretch ratio of 1:3.37, the effect could still be observed in Test No. 8 while it disappeared in Test No. 4.

While the desired dyeing effect is thus somewhat dependent upon the nominal denier of the yarn being subjected to the method of the invention, one can select suitable stretching conditions within the critical limits of the invention so as to produce denier fluctuations which are capable of giving a desirable textured effect. There is a wide selection of disperse azo dyes commonly used for dyeing polyethylene terephthalate, and various pleasing effects can be obtained, e.g. by pre-dyeing the individual threads which is also advantageous because of the shrinkage values of the novel yarn. However, the texture is also brought out in an advantageous manner by dyeing the fabric in one piece even when consisting solely of threads produced according to the invention.

Within the critical limitations of the invention, the number and size as well as the spacing of the denier fluctuations can be varied as desired without any difficulty in reproducing the specific effect desired in any given case. Also, the method of the invention achieves this result at considerably lower effort and expense as compared to prior attempts of achieving random denier fluctuations. The novel yarn of the invention is therefore produced at much lower cost while ensuring the high quality and uniformity of results required by the textile industry.

The invention is hereby claimed as follows:

1. A yarn having random denier fluctuations consisting essentially of polyester filaments having an elongation at breaking point of 30 to 80 percent, a boiling shrinkage capacity of 20 to 50 percent and about 15 to 35 nodules per meter at intervals of about 0.5 to 8 centimeters.

2. A yarn as claimed in claim 1 wherein the ratio of maximum to minimum denier is about 1.1:1 to 3.5:1.

3. A yarn as claimed in claim 2 fabricated into a textile structure and dyed with a dyestuff for polyester fibers capable of providing a different strength of dyeing as between the thicker and thinner portions of the yarn.

4. A yarn as claimed in claim 3 wherein the ratio of maximum to minimum denier is about 1.2:1 to 2.8:1.

5. A yarn as claimed in claim 4 fabricated into a textile structure and dyed with a dyestuff for polyester fibers capable of providing a different strength of dyeing as between the thicker and thinner portions of the yarn.

6. A yarn as claimed in claim 1 consisting of polyethylene terephthalate filaments.

* * * * *